United States Patent [19]

Junichi et al.

[11] 4,455,838

[45] Jun. 26, 1984

[54] CONTROL DEVICE FOR A BALANCING APPARATUS

[75] Inventors: Kita Junichi; Toshio Nagahara, both of Toyama, Japan

[73] Assignee: Toyama Machine Works, Ltd., Toyama, Japan

[21] Appl. No.: 349,099

[22] Filed: Feb. 16, 1982

[30] Foreign Application Priority Data

Feb. 16, 1981 [JP] Japan ..... 56-21233

[51] Int. Cl.[3] ..... F01B 21/04

[52] U.S. Cl. ..... 60/711; 60/426; 60/907; 74/665 A

[58] Field of Search ..... 60/426, 711, 907, 698, 60/716; 74/424.8 R, 665 A, 665 D; 91/390, 418

[56] References Cited

U.S. PATENT DOCUMENTS

| | | | |
|---|---|---|---|
| 3,842,603 | 10/1974 | Ditzen | 91/390 X |
| 3,894,476 | 7/1975 | Cobb | 91/390 X |
| 3,922,954 | 12/1975 | Gustafsson et al. | 60/426 X |

*Primary Examiner*—Allen M. Ostrager
*Assistant Examiner*—Stephen F. Husar
*Attorney, Agent, or Firm*—Sughrue, Mion, Zinn, MacPeak & Seas

[57] ABSTRACT

A control device for a balancer includes a load detector for determining the torque exerted on a driving screw attributable to the load driven and supported thereby. A fluid pressure control device increases or decreases the pressure input to a balancing torque generator in response to the detected load at a given time instant.

9 Claims, 5 Drawing Figures

CONTROL DEVICE FOR A BALANCING APPARATUS

BACKGROUND OF THE INVENTION

This invention relates to a control device for maintaining the pressure in a cylinder at a desired value.

In a general purpose industrial robot, the robot hand is moved vertically by a vertical feed screw and a motor for driving the feed screw. In this case, the light weight of the robot hand or the like is applied as a load on the motor at all times. The motor load can be reduced by holding the light weight of the robot hand with the force of the pressurized cylinder.

However, the motor load is affected not only by the inherent weight of the robot hand or the like, but also by the weight of an object gripped by the robot hand, the inertia of the robot hand in motion and external forces applied to the robot hand during acceleration or deceleration which represent variable loads applied to the motor. Therefore, the pressure in the cylinder must be controlled with high accuracy while tracking the motor load at all times. This cannot be achieved by a conventional pressure control device.

SUMMARY OF THE INVENTION

Accordingly, an object of this invention is to provide a balancing pressure control device which tracks not only an inherent load, but also a variable loads, quickly and with high accuracy.

In order to achieve the aforementioned object, in the invention, two control circuits are provided for the inherent load and the variable load, respectively: one of the two control circuits operating to provide a fixed pressure for the inherent load, and the other operating to detect the variation of the load to thereby provide the most suitable pressure to counter the variation.

DETAILED DESCRIPTION OF THE PREFERRED EMBODIMENTS

One embodiment of this invention will be described with reference to an industrial robot.

Figure 1:
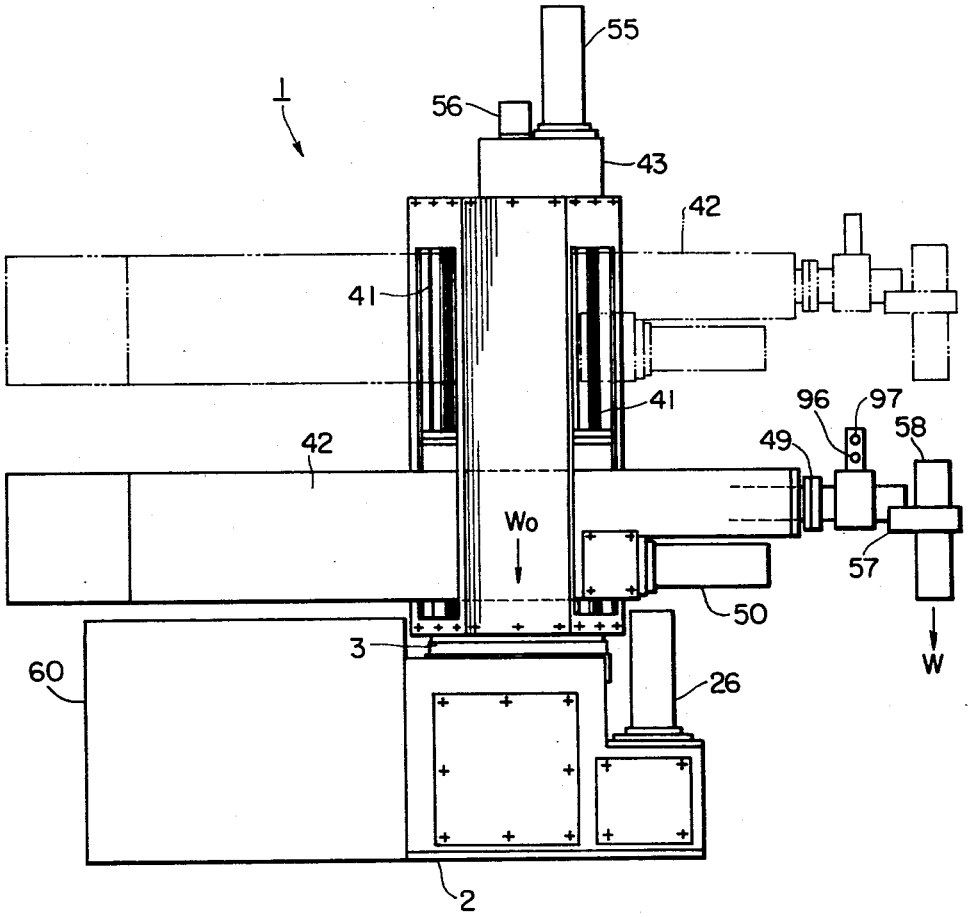
FIG. 1 is a front view of an industrial robot.
Figure 2:
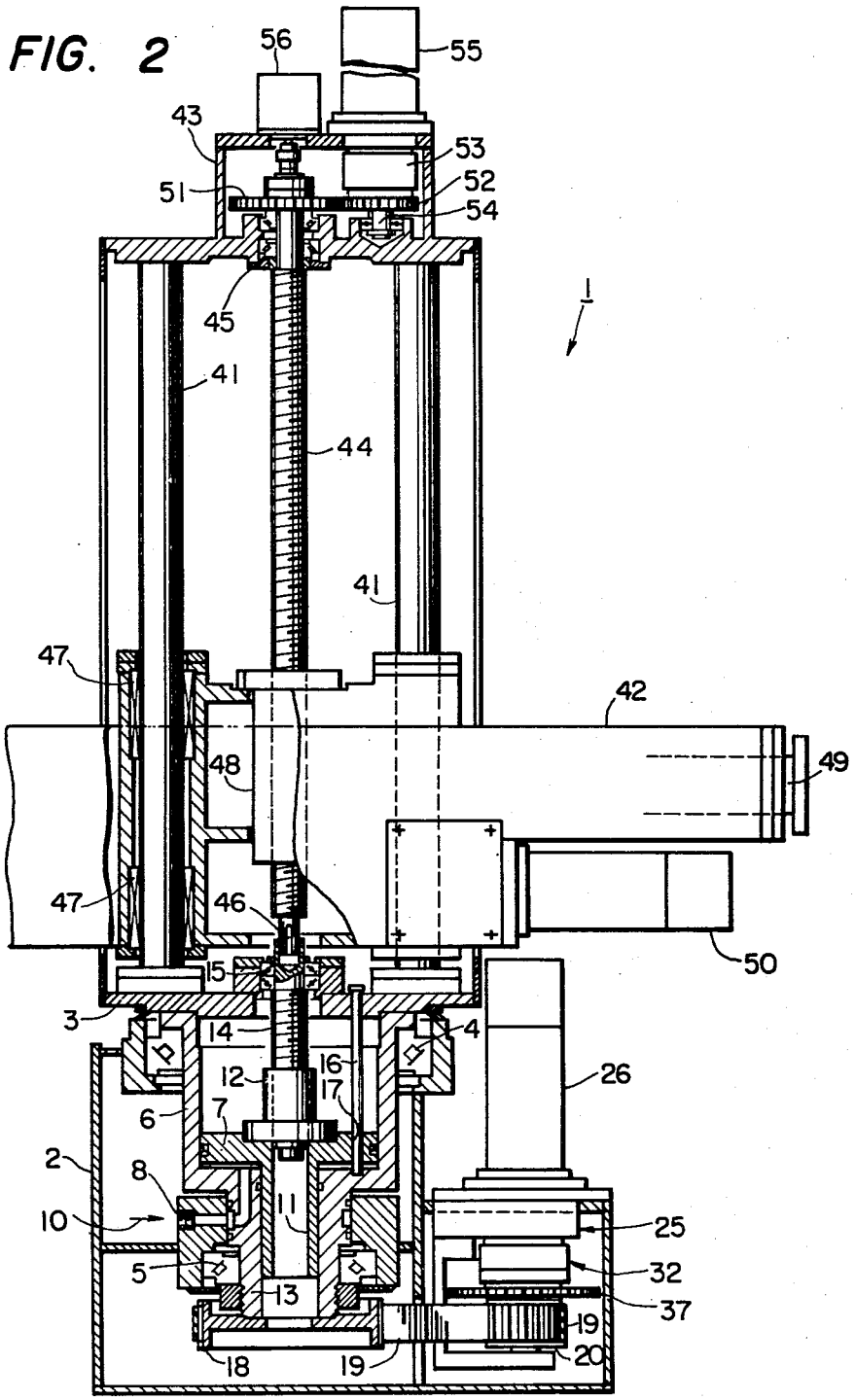
FIG. 2 is a sectional view illustrating the essential components of the industrial robot of FIG. 1.

FIGS. 1 and 2 illustrate a cylindrical coordinates industrial robot 1. The industrial robot 1 includes the necessary drive mechanisms, which are provided on a foundation (or base) 2 set on the ground or the like. The foundation 2 is in the form of a box. A swivel table 3 is provided above the box-shaped foundation 2. More specifically, the swivel table 3 is supported by upper and lower bearings 4 and 5 in the foundation 2 so that table is rotatable in a horizontal plane. The swivel table 3 itself forms a vertical balancing cylinder 6. The cylinder 6 provides a balancing pressure, and incorporates a piston 7 which divides the internal chamber of the cylinder into upper and lower chambers. The cylinder 6 receives a pressurized fluid 10 such as oil or air at a predetermined pressure through a port 8 in the lower chamber. The lower end portion of the piston 7 is formed into a hollow piston rod 11, and a ball nut 12 is set on the top of the piston 7. The piston rod 11 is guided along a guide hole 13 formed in the lower portion of the cylinder 6 while being maintained liquid tight therein. The ball nut 12 is engaged with a ball screw 14. The linear "advance" or "load" of the ball screw 14 is on the order to 10 mm, e.g. the ball nut mounted on the screw would advance linearly 10 mm for each rotation of the screw. The ball screw 14 is rotatably supported by a bearing 15 at its upper end portion. During operation, torque is exerted on the piston 7. Therefore, a shaft 16 secured to the inside of the cylinder 6 extends through the piston 7 so that the latter may not be turned by this torque. More specifically, the shaft 16 extends through a guide hole in the piston 7, so that the piston 7 is allowed to move vertically only. A timing pulley 18 is secured to the lower end of the cylinder 6, and a timing belt 19 is laid over this pulley and another timing pulley 20.

Figure 3:
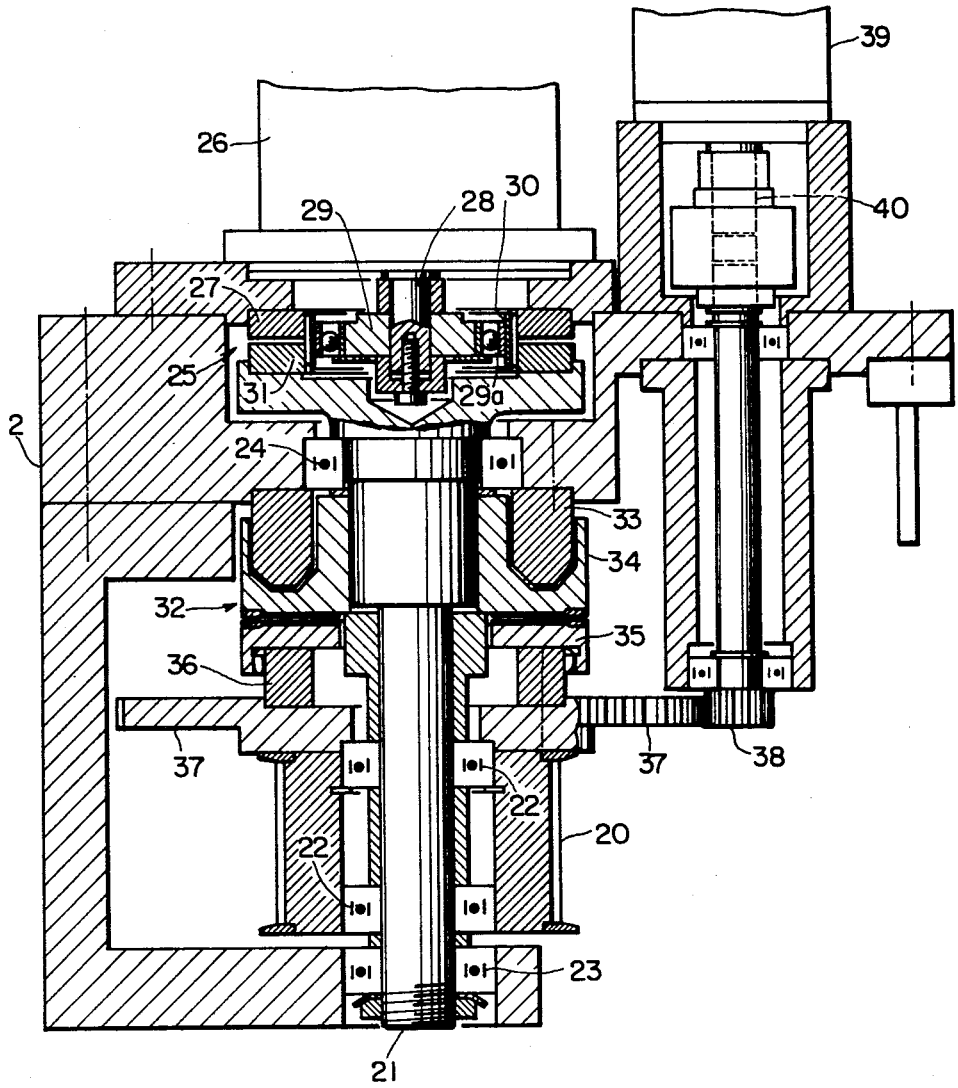
FIG. 3 is a sectional view showing the drive mechanism of a swivel table of the industrial robot.

The timing pulley 20, as shown in FIG. 3, is mounted through bearings 22 on a shaft 21 so that it is freely rotatable. The shaft 21 is provided on a side of the foundation 2 and is supported by the upper and lower bearings 24 and 23. The upper end portion of the shaft 21 is coupled to a swiveling motor 26 through a harmonic drive type reduction gear unit 25. The shaft 28 of the motor is coupled to a wave generator 29 of the reduction gear unit 25. The wave generator 29 is inserted into a wave generator bearing **29*a* to hold a flex spline 30. The flex spline 30 is engaged with a stationary circular spline 27 and an output circular spline 31 secured to the end portion of the shaft 21. A clutch 32 is provided between the shaft 21 and the timing pulley 20. The clutch 32 may be of the electromagnetic type, for instance. The exciting coil 33 thereof is secured to a part of the foundation in such a manner that it surrounds the shaft 21 and extends downwardly. A stationary clutch part 34 is mounted on the shaft 21 in such a manner as to cover the exciting coil 33. A movable clutch member 35, which is attracted by the stationary clutch member 34 and the exciting coil 33, is slidable along the shaft 21. When the exciting coil 33 is not energized, the teeth of the movable clutch part 35 are engaged with a drive adapter 36 to transmit the rotation to a gear 37 secured to the adapter 36 and to the aforementioned timing pulley 20. The gear 37 is engaged with a gear 38 so as to drive the input shaft 40 of a pulse encoder 39. The pulse encoder 39 operates to produce a pulse signal proportional to the rotation of the motor 26, i.e., the amount of rotation of the swivel table 3**. The pulse signal is used as a control signal for rotational positioning.

Referring back to FIGS. 1 and 2, two guide bars 41 are set fixedly upright on the upper surface of the swivel table 3. A movable frame 42, which is to be balanced, is guided along the guide bars 41. A gear box 43 is positioned on top of the guide bars 41. The gear box 43 has a bearing 45 which rotatably supports a lifting ball screw 44 which extends in parallel with the guide bars 41 and between the same. The lead of the ball secrew 44 is about 50 mm. The ball screw 44 is coaxially coupled through a spline 46 to the aforementioned ball screw 14 at the lower end thereof. The movable frame 42 is guided along the guide bars 41 with the aid of upper and lower slide bearings 47, and is connected to the ball screw 44 through a ball nut 48. The movable frame 42 has a robot arm 49 which can be protruded or retracted horizontally. The robot arm 49 is driven by a drive motor 50, with a robot hand 57 coupled to the end of the robot arm.

The gear box 43 incorporates speed reducing gears 51 and 52 which are inter-engaged. The gear 51 is fixedly secured to an upper end portion of the ball screw 44, while the gear 52 is fixedly secured to the output shaft 54 of a clutch 53. The clutch 53 may be an electromagnetic clutch, for instance. The input side of the clutch 53 is coupled to a lifting motor 55, so that the clutch 53 is driven by the motor 55. The motor 55 and a pulse encoder 56 are installed on the gear box 43. The pulse encoder 56, being coupled to the ball screw 44, produces a pulse signal in proportion to the amount of rotation of the ball screw 44, i.e., the amount of vertical movement of the movable frame 42. Similarly to the aforementioned pulse signal of the pulse encoder 39, the pulse signal of the pulse encoder 56 is employed as a vertical positioning control signal. A control box 60 (FIG. 1) is provided to accommodate a balancing pressure control unit 9 and an electrical control unit 80 (described hereafter).

Figure 4:
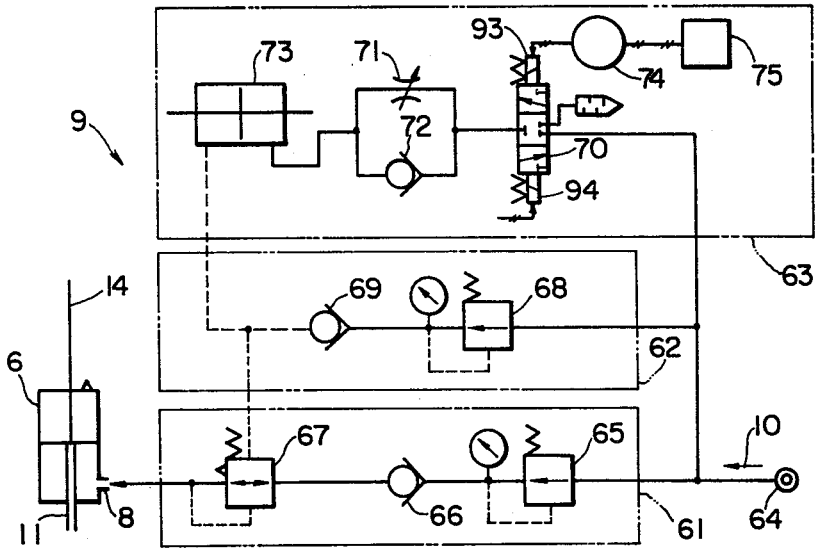
FIG. 4 is a fluid circuit diagram showing a balancing pressure control device according to the invention.

FIG. 4 illustrates one example of the balancing pressure control unit 9 for the cylinder 6. The balancing pressure control unit 9 comprises a main circuit 61, a first control circuit 62 for light weight (e.g. 42) balancing; and a second control circuit 63 for load balancing. The main control circuit 61 is for adjusting the pressure of the pressurized fluid 10 for driving the cylinder 6. The main control circuit 61 applies fluid from a pressurized fluid source 64 through a pressure reducing valve 65 for setting the pressure, a check valve 66 for preventing natural pressure drop and a pressure control valve 67 with a pilot valve, to the port 8 of the cylinder 6.

The first control circuit is for setting a pressure corresponding to the weight of the movable frame 42 to be balanced. In the first control circuit, a pressure reducing valve 68 for adjusting the pressure and a check valve 69 are connected between the pressurized fluid source 64 and the pilot pressure input port of the pressure control valve 67. The second control circuit operates to adjust the pressure in response to variable loads or other external forces which are applied as loads to the robot arm 49. In the second control circuit, an electromagnetic three-position three-way directional control valve 70, a parallel circuit of a flow rate control valve 71 and a check valve, when required, and a pressure converter 73 are connected in series between the pressurized fluid source 64 and the pressure control valve 67.

The electromagnetic three-position three-way directional control valve 70 is controlled by the on-off operation of a relay 74. The relay 74 and a load detector 75 form load detecting means, and the relay 74 is driven by the load detector 75. The load detector 75 detects the load on the robot arm 49. In this embodiment, the load detector 75 is composed of a resistor 76 for detecting a stall current generated by the lifting motor 55; however, it may be composed of a load cell.

Figure 5:
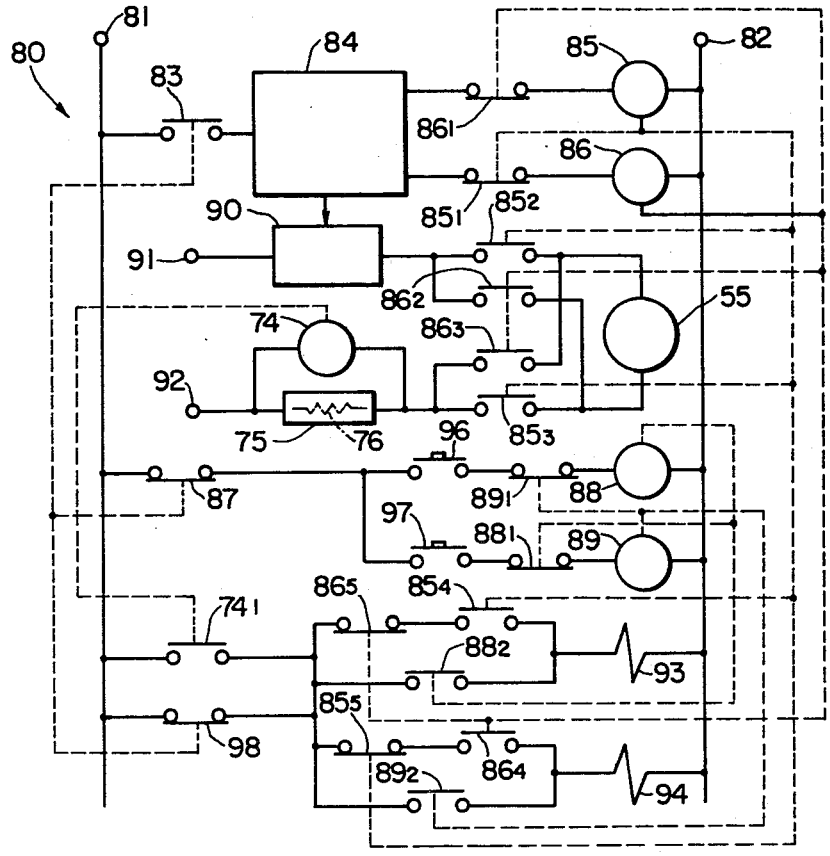
FIG. 5 is a circuit diagram, partly in block form depicting an electrical control unit employed in the invention.

FIG. 5 shows one example of an electronic control circuit 80 employed in the invention. The control circuit 80 operates to control the direction of rotation of the motor 55, to detect the stall current, and to control the on-off operation of the directional control valve 70. A contact means 83, which is closed at the time of automatic balance operation, a main control unit 84, a relay contact means $86_1$ of a relay 86 for instructing reverse rotation (downward movement) of the motor, a relay 85 for instructing forward rotation (upward movement) of the motor, a relay contact means $85_1$ of the relay 85, and a relay 86 are connected between control power source terminals 81 and 82. A series circuit of a current control circuit 90, a relay contact means $85_2$ of the relay 85, the motor 55, a relay contact means $85_3$ of the relay 85 and the detecting resistor 76 is connected between motor (55) driving DC source terminals 91 and 92. Polarity changing relay contact means $86_2$ and $86_3$ are also connected to the motor 55.

A relay 74 is connected in parallel to the detecting resistor 76. Furthermore, a manual pressure increasing relay 88, a manual pressure decreasing relay 89, and the electromagnetic valves 93 and 94 of the switching valve 70 are connected as shown in FIG. 5. The relay 88, a pressure increasing switch 96 and a relay contact means $89_1$ are connected in series between the control power source terminals 81 and 82. The relay 89, a pressure decreasing switch 97 and a relay contact means $88_1$ and connected in series between the control power source terminal 82 and the connecting point of the contact means 87 and the pressure increasing switch 96.

The electromagnetic coil 93 is connected through a relay contact means $88_2$ to a first terminal of a contact means 98, the other terminal of which is connected to the control power source terminal 81. The electromagnetic coil 94 is connected through a relay contact means $89_2$ to the first terminal of the contact means 98. A relay contact means $74_1$ is connected in parallel with the contact means 98. A series circuit of relay contact means $86_5$ and $85_4$ and a series circuit of relay contact means $85_5$ and $86_4$ are connected in parallel with the relay contact means $88_2$ and $89_2$, respectively. In FIG. 5, the circuit elements connected with the broken lines are operated simultaneously.

The operation of the industrial robot 1 thus constructed will now be described. The robot arm 49 is protruded or retracted by operating the drive motor 50. More specifically, the robot arm 49 goes in and out of the movable frame 42 according to the direction of rotation of the motor 50.

The swivel table 3 is turned by starting the motor 26. The rotation of the motor shaft 28, after being reduced by the reduction gear unit 25, is transmitted to the shaft 21. When, under this condition, the exciting coil 33 is energized, the movable clutch part 35 is magnetically attracted to the stationary clutch member 34, so that the rotation of the shaft 21 is transmitted to the gear 37 and the timing pulley 20, and the rotation of the timing pulley 20 is transmitted through the timing belt 19 to the timing pulley 18. As a result, the swivel table 3 is turned relative to the foundation 2 while supporting the movable frame 42. The angle of swivel, in this case, can be limited by a limit switch (not shown) on the foundation 2 and a corresponding dog (not shown) provided on the swivel table 3.

The movable frame 42 can be moved up or down by starting the motor 55. The direction of rotation of the motor 55 is determined by the main control unit 84 when the contact means 83 is closed. The main control unit 84 operates to execute predetermined programs, and to provide suitable drive currents for start, stop, acceleration and deceleration. When the relay 85 is energized, its contact means $85_2$ and $85_3$ are closed to cause the motor 55 to turn in the forward direction. On the other hand, when the relay 86 is energized, its contact means $86_2$ and $86_3$ are closed so that the motor 55 is rotated in the reverse direction. The rotation of the motor 55 is transmitted to the clutch 53 and the gears 51 and 52, to drive the ball screw 44. When the motor 55 turns in the forward direction, the ball screw 44 drives the ball nut 48 so that the movable frame 42 is moved upwardly. On the other hand, when the motor 55 turns in the reverse direction, the ball screw 44 moves the movable frame 42 downwardly. During the upward or downward movement of the movable frame, the latter tends to turn with the ball screw 44; however, the turning of the movable frame 42 is prevented by the pair of guide bars 41. The robot hand 57 is moved between the specified points as instructed by combination of the above-described stretching, swiveling and lifting motions.

The light weight (Wo) of the movable frame 42 is applied to the ball screw 44 so that torque is applied to the ball screw 44 at all times. Accordingly, a load attributable to this weight (Wo) is applied to the motor 55 at all times, and accordingly, even when the motor 55 is stopped. In order to overcome this force, the cylinder 6 receives pressurized fluid 10 to impart torque to the ball screw 14, which cancels the torque of the ball screw 44 due to the weight (Wo). More specifically, the piston 7 in the cylinder 6, being pushed upwardly by the pressurized fluid 10, applies an upwardly directed force on the ball unit 12, so that the ball screw 14 cancels out the torque of the ball screw 44. In this operation, the pressure in the cylinder 6 is controlled by the pressure reducing valve 68. The pressure control valve 67 in the main circuit 61 is of a diaphragm type high in both accuracy and speed. In the pressure control valve 67, a specified pilot pressure, which is set by the pressure reducing valve 68, is compared with the internal pressure of the cylinder 6, so that the pressurized fluid 10 is supplied to or returned from the cylinder 6 through the main circuit 61, whereby the internal pressure of the cylinder 6 is maintained at the specified pilot pressure. When the pressure of the pressuized fluid source 64 is decreased from some reason, the check valves 66 and 69 operate to prevent reverse flow, i.e., to prevent abnormal operation. In addition, the security control of the robot is effected by a pressure detecting switch (not shown) provided for the pressurized fluid source 64, so that, when the switch detects an abnormal pressure decrease, the operation of the industrial robot 1 is automatically stopped.

The lead of the ball screw 14 is about one-fifth of the lead of the ball screw 44, as described previously. Therefore, the length of the ball screw 14 may be one-fifth of that of the ball screw 44; however, it should be noted that the ball screw 14 serves to cancel the torque over the entire stroke, i.e. between the upper and lower limit positions, of the movable frame 42. This is effective in reducing the length of the cylinder 6 and in miniaturizing the device. The ball screws 14 and 44 are coaxial with one other. This coaxial arrangement is effective in directly connecting the upper and lower ball screws 14 and 44 to one other; However, the ball screws 14 and 44 may be connected through a pair of spur gears so that they are parallel to each other, or they may be coupled together through a pair of bevel gears so that they are perpendicular to each other. If, in this case, the number of gear teeth of the ball screw 14 engaged with the ball screw 44 is larger than the number of gear teeth of the ball screw 44, then the length of the ball screw 14 can be made shorter than that of the ball screw 44, even if the lead of the ball screw 14 is equal to the lead of the ball screw 44.

When an object 58 is gripped and moved by the robot hand 57, the weight (W) of the object 58 is imparted as a load to the motor 55. The load is not always constant. That is, different objects provide different loads, and the load is varied when the object is moved upward or downward and when the acceleration is changed, during the object carrying operation. Accordingly, the pilot pressure of the pressure control valve 67 must be automatically adjusted with the variations of the load. The variations of the load are corrected by the second control circuit 63 and the electrical control circuit 80.

The series of load variation correcting operations are as follows: The main control unit 84 detects when the robot hand 57 grips an object 58, and the unit 84 energizes the relay 85 to turn the motor 55 in the forward direction, so that the movable frame 42 is moved upwardly. In this operation, the input current of the motor 55 is controlled according to the desired acceleration and upward movement speed by the current control circuit 90 at all times. The DC motor 55, having a self adjustment function, changes the input current according to the increase or decrease of torque applied to the ball screw 44. When the input current exceeds a certain value, a predetermined voltage is developed across the detecting resistor 76 in the load detector 75. The relay 74 is driven by the voltage to close its contact means $74_1$. As, in this case, the relay contact means $85_4$ is closed, the pressure increasing electromagnetic coil 93 drives the directional control valve 70, so that the pressurized fluid 10 is applied through the check valve 69 and the pressure converter 73 to the pilot pressure input terminal of the pressure control valve 67. Thus, the pressure in the cylinder 6 is automatically increased to overcome the torque of the ball screw 44. The above-described correcting operation responds accurately not only to the load torque variation due to the weight (W) of the object 58, but also to the load torque variation which is caused when the movable frame 42 is moved upwardly, or when the acceleration is changed during movement, or when the movable frame 42 is stopped, because the motion of the movable frame 42 is related directly to the input current of the motor 55. Thus, the DC motor 55 is an essential element forming a part of the detecting means. The detecting means may employ a method of detecting the thrust load of the ball screw 44, and therefore the detecting means may also be composed of a load detecting means such as a load cell.

When the movable frame 42 approaches the stop position after being sufficiently accelerated, the main control unit 84 operates to brake the motor, to reduce the speed. When the movable frame 42 is moved downwardly, a voltage proportional to the current of the motor 55 is developed across the detecting resistor 75. When the voltage is increased to a predetermined value, the relay 74 is actuated to close its contact means $74_1$. In this case, the motor 55 is turned in the reverse direction and the relay contact means $86_4$ is closed. Therefore, the electromagnetic coil 94 drives the directional control valve 70, so that the pilot pressure setting pressurized fluid 10 of the pressure converter 73 is returned through the flow rate adjusting valve 71 to the directional control valve 70 and is discharged through the outlet of the latter, whereby the pilot pressure is adjusted. In association with the pilot pressure adjustment, the pressure control valve 67 operates to discharge pressurized fluid 10 from the cylinder 6, in order to reduce the pressure in the cylinder 6.

The pressure converter 73 is provided so that no impulsive pressure variation is applied to the pilot pressure input terminal of the pressure control valve 67, i.e., a buffer action is effected, and also so that the pilot pressure of the pressure control valve 67 may not be decreased to a value lower than the light weight (Wo) compensation pressure. When the directional control valve 70 is opened to the atmosphere because of the pilot pressure decrease, the piston in the pressure converter 73 is pushed towards the input port by the pilot pressure, and is stopped there. Therefore, the pilot pressure of the pressure control valve 67 is not decreased below the light weight compensation pressure.

The industrial robot 1 is one of the direct teaching and playback type, in order to increase its range of application. Therefore, if the operator teaches reference operations to the robot before work begins the reference operations are stored in a memory unit separately provided, and the robot carries out the operations repeatedly. In teaching the operations, the movable frame 42 is manually moved in a vertical direction to a desired position and the position is stored, and the swivel table 3 is turned through a desired swivel angle and this position is stored. In this operation, it is necessary that all the movable parts concerning the teaching operation be manually movable with ease. For this purpose, the lead of the ball screw 44 is made as coarse as possible. However, when the movable parts are moved manually as described above, the reduction gear unit 25 and the speed reducing gears 51 and 52 in the drive system are driven reversely, and frictional forces are involved, and therefore the manual operator requires a large force to drive the reduction gear unit and the speed reducing gears reversely. In order to eliminate this difficulty, in teaching the data, the clutches 32 and 53 are operated to disconnect the drive system, which is a load in the teaching operation. That is, when the exciting coil 33 of the clutch 32 is deenergized, the movable clutch part 35 is disengaged from the stationary clutch half 34, as a result of which the shaft 21 is disconnected from the timing pulley 20 and therefore the swivel table 3 can be turned with ease. On the other hand, the upper clutch 53 disconnects the motor 55, which becomes a load to the ball screw 44 in the teaching operation, and therefore the ball screw 44 can be readily turned. Thus, the movable frame 42 can be easily manually moved vertically, while the swivel table 3 can be manually turned with ease. The ball screws 14 and 44 are essential in order to reduce slide friction; however, they may be replaced by feed screws.

In the teaching operation, the light weight (Wo) of the movable frame 42 and the weight (W) of the object 58 gripped by the robot hand 57 become loads which are applied to the operator, and accordingly the operator requires large force to carry out the teaching operation. The light weight (Wo) of the movable frame 42 is compensated by the operation of the first control circuit 62 at all times, as described before, but the weight (W) of the object 58 gripped by the robot hand is not compensated because the motor 55 forming a part of the detecting means is disabled. Therefore, the weight (W) is compensated by manual pressure increase or decrease. First, when the robot hand 57 grips the object 58, the operator turns on the pressure increasing switch 96. In the teaching operation, the contact means 87 is maintained closed, and the relay contact means $89_1$ is not operated, i.e., it is closed. Therefore, the relay 88 is energized, so that its contact means $88_2$ is closed, whereupon the electromagnetic coil 93 is energized through the circuit of the closed contact means 98 and the relay contact means $88_2$, to drive the switching valve 70 to increase the pressure. When the operator detects when the robot arm 49 becomes manually movable upwardly, he turns off the pressure increasing switch 96. As a result, the directional control valve 70 is set to the intermediate position, and from this instant the pressure in the cylinder 6 is maintained increased. Therefore, the robot hand 57 holding the object 58 is maintained in balance with the light weight (Wo) of the movable frame 42 and the weight (W) of the object 58. Under this condition, the operator moves the robot hand 57 upwardly, swivels it horizontally, moves it downwardly, and sets the object 58 at a predetermined position. When the robot hand 57 releases the object 58, the compensation condition of the robot hand 57 must be restored to the light weight compensation condition. For this purpose, before the robot hand 57 releases the object 58, the operator turns on the pressure decreasing switch 97, so that the relay 89 causes the directional control valve 70 to reduce the pressure, to thereby reduce the pilot pressure of the pressure control valve 67 to the light weight compensation value.

The above-described manual operation is required because the detecting terminal of the second control circuit 63 is made up of the motor 55, which is operated during automatic operation only. However, if the detecting means of the second control circuit 63 is composed of the aforementioned load cell so as to directly detect the thrust load of the ball screw 44, then compensation for the weight of the object 58 can be automaticaly carried out.

In the above-described embodiment, the pressure control device according to the invention is built into an industrial robot; however, it can be applied to counterbalancing devices in other industrial machines. In this case, the load of the feed motor may correspond to the force of driving the reciprocating stand, or the machining resistance of the machining feed.

According to the invention, in response to variations of the load, the internal pressure of the cylinder is automatically set in balance with the load, so that the balancing operation is effected with high accuracy. Furthermore, the first control circuit and the second control circuit operate for the inherent load and the variable load, respectively. Therefore, the compensation pressure varies in a smaller range, and accordingly the control response is quick, and the control characteristic is improved.

In the case where the second control circuit includes a flow rate adjusting valve, a check valve and a pressure converter, the transient operation in increasing or decreasing the pressure can conform to the motion characteristics of the part to be balanced, and the pressure can be smoothly transmitted.

In the case where the pressure increase and decrease controlling switching valve is operated by the drive motor current detecting means, it is unnecessary to provide the detector, and the dynamic load variation can be accurately detected.

What is claimed is:

1. A balancing pressure control device, comprising:

a main circuit including a pressure control valve having a pilot valve connected between a balancing cylinder and a pressurized fluid source, to supply a pressurized fluid at a predetermined pressure to said cylinder;

a first control circuit for applying a control pressure corresponding to a fixed load on a part to be balanced by said cylinder to a pilot pressure input terminal of said pressure control valve; and a second control circuit for detecting a variable load applied to said part to be balanced, for producing a control pressure corresponding to the variable load, and for applying said control pressure thus produced to said pilot pressure input terminal of said pressure control valve.

2. A device as claimed in claim 1, in which said second control circuit has a series circuit of a parallel circuit of a flow rate adjusting valve and a check valve; and a pressure converter, which is connected between said pressurized fluid source and said pilot pressure input terminal of said pressure control valve.

3. A device as claimed in claims 1 or 2, wherein said second control circuit is provided, on the side of said pressurized fluid source with a directional control valve for increasing or decreasing a pilot pressure of said pressure control valve, and load detecting means for detecting a variable load applied to said part to be balanced, to drive said directional control valve.

4. A device as claimed in claim 3, in which said load detecting means comprises a load detector for an input current of an electric motor applied to drive said part to be balanced, and a relay which is driven by said load detector, to drive said directional control valve.

5. A device as claimed in claim 2, said pressure converter including means for preventing a decrease in pilot pressure applied to said pilot pressure input beyond a point where said inherent load is compensated.

6. A device as claimed in claims 1 or 2, said main circuit further including, on the source side of said pressure control valve, a series connection of a check valve and a pressure reducing valve.

7. A device as claimed in claim 4, further including means for driving said directional control valve manually when said load detector is disabled by disconnection of said motor.

8. A device as claimed in claim 7, said motor forming a part of said load detecting means, said inherent load being compensated regardless of the control mode of said directional control valve.

9. A device as claimed in claims 1 or 2, said pressure exerted on said balancing cylinder being converted to a mechanical torque balancing a torque acting on said part to be balanced and constituting a load on said motor.

* * * * *